United States Patent [19]

Hutterer et al.

[11] 3,969,157

[45] July 13, 1976

[54] METHOD OF PROVIDING DECARBONIZATION PROTECTION FOR METALLIC SURFACES

[75] Inventors: Klaus Hutterer; Walter Schwarz; Ekkehart Krainer, all of Kapfenberg, Austria

[73] Assignee: Vereinigte Edelstahlwerke AG, Vienna, Austria

[22] Filed: Aug. 6, 1974

[21] Appl. No.: 495,150

[30] Foreign Application Priority Data

Aug. 7, 1973 Austria ..... 6910/73

[52] U.S. Cl. ..... 148/14; 148/27; 427/156; 427/372; 427/401

[51] Int. Cl.[2] ..... C21D 1/34

[58] Field of Search ..... 117/135.1, 130 R, 169 R, 117/169 A; 148/14, 27; 427/156, 372, 401

[56] References Cited

UNITED STATES PATENTS

| | | | |
|---|---|---|---|
| 3,222,228 | 12/1965 | Stanley et al. | 148/16 |
| 3,429,753 | 2/1969 | Wagner | 148/6 |
| 3,673,005 | 6/1972 | Kunst | 148/6 |
| 3,770,512 | 11/1973 | Bopp | 148/6 |

*Primary Examiner*—Harry J. Gwinnell

[57] ABSTRACT

An improved technique is described for effecting decarbonization protection for the surfaces of ferrous metals during heat treatment in an oxidation atmosphere. The surface to be protected is coated, prior to the heat treating step, with a paste-like substance preferably formed from a mixture of boron carbide, potassium boron fluoride, borax and an aqueous binder. The resulting protective coating, which may be sprayed on the relevant surface, has a maximum thickness of .1 mm. Such relatively thin coating having the described composition, which in larger thicknesses is useful for boron-hardening of metallic surfaces, is effective to provide the required decarbonization protection without the accompanying disadvantages of excessive boron atom diffusion.

5 Claims, 2 Drawing Figures

METHOD OF PROVIDING DECARBONIZATION PROTECTION FOR METALLIC SURFACES

BACKGROUND OF THE INVENTION

Several techniques are presently known for the decarbonization protection of metallic surfaces (particularly those of ferrous materials) during heat treatment of such materials. In one arrangement of this type, a coating of borax is placed directly on the surface to be protected, and serves during the heat treatment to form accelerated scaling on such surface. When the scale is removed, the exposed surface is relatively free of decarbonizing.

An additional arrangement, which is in some respect superior to the borax treatment, employs as the coating material a ceramic frit which has a high concentration of boron oxide or the like. It has been found that such substance provides a more highly viscous and adherent film on the relevant surface than does borax.

SUMMARY OF THE INVENTION

The method of the present invention concerns a new way of providing a surface coating to afford the required decarbonizing protection of a metallic surface, particularly a ferrous surface. Basically, the coating is formed as a very thin (1 mm max.) layer of a paste-like mixture of ingredients whose properties, when applied in relatively thick layers, are already known for their boronizing capabilities. In particular, such thick coatings have already been used to increase the hardness of steel surfaces, e.g., by converting the first 20–400 microns or so of such surface into FeB or $Fe_2B$ via the diffusion of boron from the mixture into the adjoining steel surface.

The mixture consists basically of (1) one or more known boron-emitting substances, such as boron carbide (2) an activator such as fluoro borate and/or a halogen compound of an earth or alkaline earth metal or ammonium, and (3) a liquid binder.

A particularly effective formulation of this type consists of 10 – 80% by weight (preferably 20 – 60% by weight) of boron carbide, 2 – 10% by weight of alkali fluoro borate, and the remainder an aqueous binder such as waterglass, methylcellulose, or resin glue.

BRIEF DESCRIPTION OF THE DRAWING

The method of the invention is further set forth in the following detailed description taken in conjunction with the appended drawing in which.

DETAILED DESCRIPTION

The characteristics of the inventive method can be best illustrated by an exemplary sequence of steps for providing decarbonization protection of a steel bar having a 0.6% carbon concentration and measuring 80 mm on a side.

The surfaces of the bar are first suitably degreased, and are then sprayed, in accordance with the invention, with a thin coating (1 mm max.) consisting of 30% by weight of boron carbide, 3% by weight of potassium boron fluoride, and the remainder liquid sodium silicate. The so-protected steel bar sample is then subjected to a 4-hour heat treatment, during which the bar is heated to incandescence at about 850°C.

After the heat treatment, the bar is permitted to cool down and the adhering thin protective layer is removed by suitable means, e.g. a dilute 10% solution of phosphoric acid.

During one typical test run under these conditions, by which a thin coating of 0.8 mm was obtained, the sample, after removal of the coating as indicated above, was etched transversely with a 2% solution of nitric acid. Thereafter, photomicrographs having a 250 to 1 enlargement were taken. One such photomicrograph is shown in FIG. 1.

Figure 1:
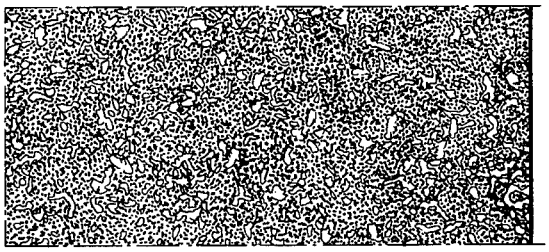
FIG. 1 is a photomicrograph taken after the heat treatment of a steel workpiece whose surface has been afforded decarbonization protection in accordance with the invention.

A careful inspection of FIG. 1 indicates that no significant boron diffusion, which would lead to undesirable changes in hardness in the steel surface, was obtained when the technique of the invention was used. This fact was also verified by means of separate metallographic probes, wherein microhardness measurements, measured with 50 ponds indicated that the hardness of the structure was constant within a very narrow tolerance from the surface to a significant extent into the interior of the sample.

Figure 2:
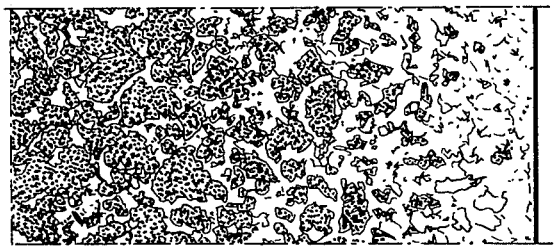
FIG. 2 is a photomicrograph, taken under similar conditions to that of FIG. 1, illustrating the condition of an untreated surface of a steel workpiece after heat treatment.

For comparison, photomicrographs were also taken, as shown in FIG. 2, of the end zone of an unprotected steel bar sample that was heat treated under the same conditions as the test sample leading to the results in FIG. 1. In particular, the characteristics of FIG. 2 illustrate a strong decarbonizing of the test sample, such decarbonizing extending to a depth of about 0.2 mm into the interior of the sample.

In the foregoing the method of the invention has been described in connection with an illustrative sequence of steps. Many variations and modifications of such sequence will now occur to those skilled in the art. It is accordingly desired that the scope of the appended claims not be limited to the specific disclosure herein contained.

What is claimed is:

1. In a method of providing decarbonization protection of a metallic surface, particularly the surface of a ferrous material, during heat treatment thereof, wherein a boron-containing substance is deposited on the surface to form an adherent scale during the heat treatment step, and wherein the scale is removed after such heat treatment, the improvement wherein the depositing comprises the step of coating the surface to be protected with a thin paste-like substance prior to the heat treatment, said substance consisting essentially of from about 12 to about 80% of at least one boron-emitting material, an activator, and an aqueous binder, the maximum thickness of such coating being 1 mm, whereby the required decarbonization protection is provided without undesired hardening of the surface by significant infusion of boron atoms therein.

2. The method according to claim 1, in which the boron-emitting material is selected from at least one of the group consisting of boron carbide, iron boride, amorphous boron, and borax.

3. The method according to claim 1, in which the activator is selected from at least one of the group consisting of a fluoro borate, a halogen compound of an alkaline metal, and a halogen compound of an alkali earth metal.

4. The method according to claim 1, in which the binder is selected from the group consisting of waterglass, methylcellulose, and sodium silicate.

5. The method according to claim 1, in which the paste-like substance is formed from a mixture of boron carbide, borax, potassium boron fluoride, and an aqueous liquid binder.

* * * * *